US007487564B2

(12) United States Patent
Miller

(10) Patent No.: US 7,487,564 B2
(45) Date of Patent: Feb. 10, 2009

(54) ARTICULATABLE SPRING MECHANISMS FOR ITEMS OF FURNITURE

(75) Inventor: John Miller, 1016 Monroe St., Tupelo, MS (US) 38801

(73) Assignees: John Miller, Tupelo, MS (US); Item Development Inc., Cortez, FL (US)

( * ) Notice: Subject to any disclaimer, the term of this patent is extended or adjusted under 35 U.S.C. 154(b) by 38 days.

(21) Appl. No.: 11/041,059

(22) Filed: Jan. 11, 2005

(65) Prior Publication Data

US 2006/0150326 A1 Jul. 13, 2006

(51) Int. Cl.
*A47C 17/26* (2006.01)

(52) U.S. Cl. ..... 5/716; 5/1; 5/2.1

(58) Field of Classification Search ..... 5/1, 5/2.1, 6, 716; 267/95, 103, 165
See application file for complete search history.

(56) References Cited

U.S. PATENT DOCUMENTS 3,235,888 A * 2/1966 Nystrom ..... 5/2.1
5,540,418 A * 7/1996 Miller ..... 267/95

* cited by examiner

*Primary Examiner*—Fredrick Conley
(74) *Attorney, Agent, or Firm*—Kirschstein, et al.

(57) ABSTRACT

A quiet, non-binding articulatable spring mechanism for resiliently supporting a mattress includes a system of articulatable, sinuous springs, each having hooked ends for silencing the mechanism during use or collapse, as well as central offset portions for enabling the sinuous springs to compress to a greater extent than heretofore. Both rigid and yieldable support structures connect the spring mechanism to an item of furniture.

11 Claims, 9 Drawing Sheets

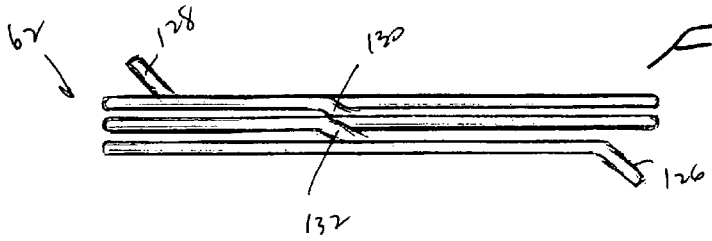
FIG. 9
FIG. 10
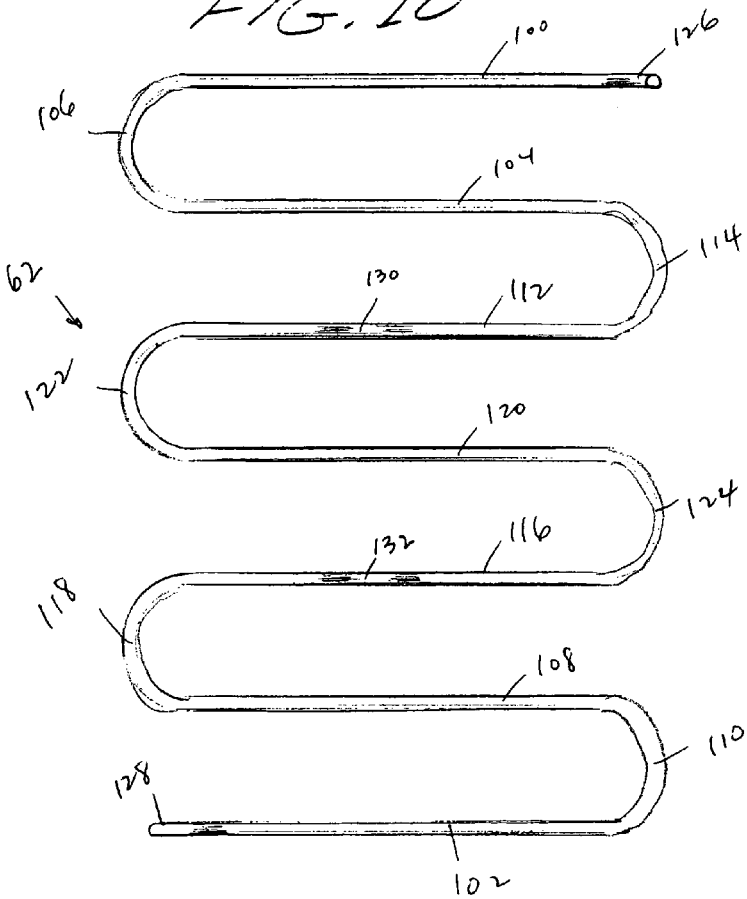
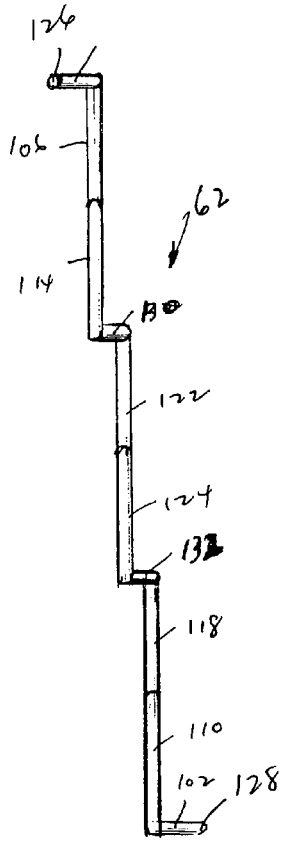
FIG. 11

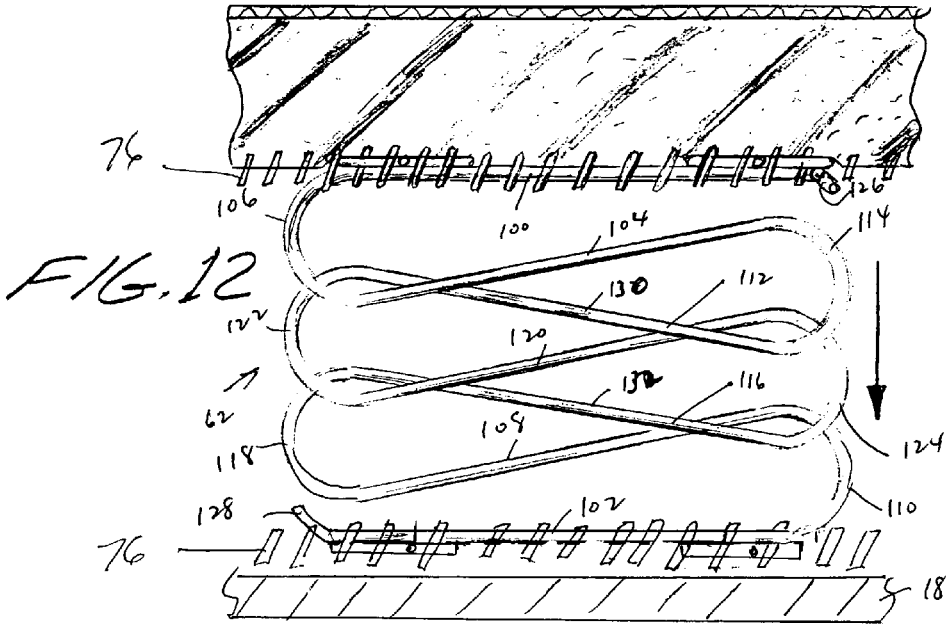
FIG. 12
FIG. 14
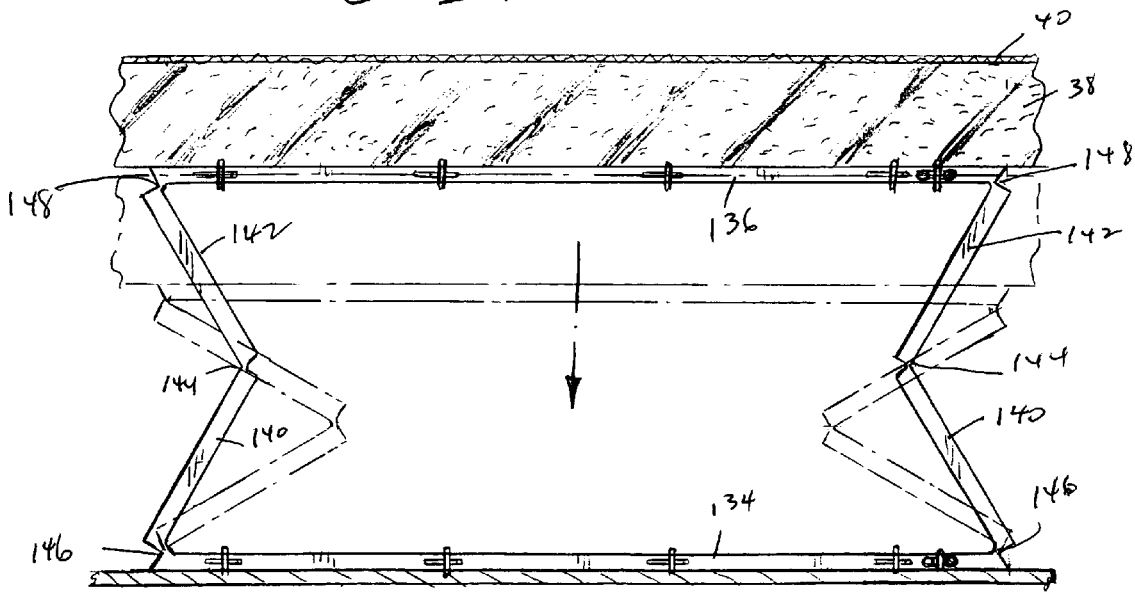

ARTICULATABLE SPRING MECHANISMS FOR ITEMS OF FURNITURE

BACKGROUND OF THE INVENTION

1. Field of the Invention

The present invention generally relates to furniture having a spring mechanism for resiliently supporting a person during use, but being articulatable for compact storage, and, more particularly, to improvements in the structure, function, operation and assembly of such spring mechanisms.

2. Description of the Related Art

It is generally known that foldaway or foldable beds are attractive bedding options for persons with restricted living space, such as are commonly found in recreational vehicles, trailers, boats, studio apartments, and the like. A Murphy-style bed includes a mattress that can be swung or folded into a wall-mounted cabinet or closet when not being used for sleeping. A convertible foldable bed folds upon itself, either one or two times, for compact storage and to serve as a sofa or seating area, and then is unfolded into a bed for sleeping. The convertible sofa-bed includes a mattress that is sufficiently flexible to fold upon itself, and that is supported and deployed by an articulated bed frame.

Although generally satisfactory for their intended purposes, the known foldable beds have exhibited some drawbacks. For maximum sleeping comfort the mattress is desired to be relatively firm and thick. However, a thick, firm mattress is not readily foldable, and certainly not in furniture of contemporary style where a low seat height and small dimensions are aesthetically desirable. In foldaway beds, a thick mattress requires a deeper cabinet or closet, thereby encroaching on the already limited living space. Where style and space requirements are paramount, a thin, foldable, soft and easily crushable mattress is employed; however, the result is often an unsatisfactory sleeping surface.

To solve the aforementioned problems, I have developed several spring mechanisms within mattresses, the mechanisms being articulatable or collapsible for compact storage and being expandable for resiliently supporting a person during use. Reference can be made, for example, to my earlier patents, namely, U.S. Pat. Nos. 4,489,450; 4,654,905; 4,620,336; 5,184,809; 5,431,376; 5,535,460; 5,539,940; 5,539,944; 5,540,418; 5,524,305; 5,642,536 and U.S. Pat. No. 5,655,240.

As exemplified by these patents, each mechanism has an upper wire grid located below an upper mattress face, a lower wire grid located above a lower mattress face, and a system of generally planar, collapsible springs pivotably connected at opposite ends to the grids. When the mattress is in the body-supporting use position, the collapsible springs are upright in parallel planes generally parallel to head and foot end faces of the mattress. However, as the mattress is moved to the storage position, the collapsible springs pivot about the grids; and the upper and lower grids shift longitudinally and are drawn closer together, thereby decreasing the distance between the upper and lower mattress surfaces and decreasing the thickness of the mattress so that it can be compactly stored.

Experience has shown, however, that the collapsible spring mechanisms of these patents have certain shortcomings. One is the expense of production which is relatively high, primarily due to the requirement for special wire forming machinery. Another is the tendency of the collapsible springs to rotate beyond their upright position. Still another is the extent to which each collapsible spring can be compressed. Limited compression of collapsible springs render the mattress less comfortable for sleeping. Yet another is mechanical contact between adjacent portions of the collapsible springs which, when the mattress is repeatedly compressed, can be noisy and undesirable for a sleeping occupant. Also related to this noise issue is the tendency of the ends of the collapsible springs to suddenly snap off helical interconnecting coils that interconnect the collapsible springs transversely along the mattress. The sudden snapping of these spring ends is not only quite noisy, but also disconcerting to the occupant who may fear that the mattress is about to imminently collapse. An additional shortcoming is the complex, labor-intensive, clip-type connection between longitudinal grid wires and a border wire on each grid.

SUMMARY OF THE INVENTION

OBJECTS OF THE INVENTION

Accordingly, it is a general object of this invention to improve the operation and assembly of collapsible spring mechanisms used in furniture, especially for mattresses.

More particularly, it is an object of the present invention to provide a collapsible spring that can be compressed to a greater depth or extent than is currently available for such springs of the prior art.

Still another object of the present invention is to provide a reliable means to effectively prevent the collapsible springs from rotating past their upright position.

It is yet another object of the present invention to reduce, if not eliminate, noise generated during compression of the collapsible springs, as well as during shifting or rolling by the occupant.

A still further object of the present invention is to strengthen the upper and lower grids for firmer support.

A still further object of the present invention is to provide grid wires that can easily be connected to a border wire via automated equipment.

A still further object of the present invention is to provide a mattress collapsible to minimal dimensions for compact storage to conserve living space.

A concomitant object of the present invention is to construct a spring mechanism of the above type so as to be relatively simple in construction, inexpensive to manufacture, easy to use, and yet reliable in operation.

FEATURES OF THE INVENTION

In keeping with the above objects and others which will become apparent hereinafter, one feature of the present invention resides, briefly stated, in a furniture item, for example, a foldaway or foldable bed, convertible sofa-bed, or like motion furniture, comprising a support and a movable mattress mounted thereon for movement between a storage position and a body-supporting use position. In a currently preferred application, the furniture item is a Murphy-style bed, and the support is a wall-mounted cabinet in which the mattress is stored in an internal storage compartment.

In further accordance with this invention, a spring assembly is used for resiliently supporting the mattress in the use position. The spring assembly includes an upper wire grid, a lower wire grid, and a system of collapsible springs pivotably connected to the grids for movement from a collapsed position in which the grids are adjacent one another in close proximity when the mattress is in the storage position for compact storage, along an opening direction, to an upright position in which the grids are resiliently held and spaced apart by the collapsible springs when the mattress is in the use position, for example, for sleeping.

The spring assembly is mounted on the support by a support structure having a pair of spaced-apart upper and lower support elements to which the upper and lower wire grids are pivotably mounted. The support elements are either rigidly or resiliently held apart. In the case of a rigid support structure, it is mounted away from the main sleeping surface of the mattress, for example, in the cabinet, for user comfort. In the case of a yieldable support structure, it is mounted either away from, or within, the main sleeping surface of the mattress. For example, the yieldable support structure can be mounted on an articulated frame which is used for folding or unfolding the mattress.

One feature of the present invention relates to the structure and operation of the collapsible springs. Each collapsible spring is sinuously formed of a single length of wire with multiple runs and arcuate portions or turns, and roughly resembles the letter "S" repeated a number of times without interruption. Each spring has upper and lower linear runs having hooked ends for hookingly engaging respective interconnecting coils that are arranged in mutual parallelism transversely across both the upper and lower wire grids. This type of sinuous spring has not heretofore been provided with hooked ends and, as a result, the ends of the prior art springs tend to withdraw from the interconnecting coils with concomitant sudden, undesirable popping sounds.

Each sinuous spring of this invention also has at least one offset, and preferably a pair of offsets, formed in central regions of intermediate runs of the spring. Hence, the spring enables the runs adjacent the offset(s) to bypass each other to a greater extent than heretofore during compression of the spring for greater user comfort. The runs of each spring therefore lie in different spaced-apart planes.

Still another feature of this invention resides in ensuring that each interconnecting coil encircles the upper and lower linear runs of each sinuous spring along their entire lengths thereof for improved strength and mattress support. In the known sinuous springs of the prior art, these upper and lower linear runs had stops for resisting movement of the collapsing springs along the opening direction past the upright position. These stops were offset from the remainder of the linear upper and lower runs and, hence, the interconnecting coils could not encircle these offset stops, thereby leading to an overall weakening of the assembly.

The function of resisting over-rotation of the collapsible springs is, in accordance with this invention, not performed by means within the spring assembly, for example, by the aforementioned offset stops, but instead, by means outside the spring assembly and remote from the collapsible springs. Such means are aided by the aforementioned support structure mounted on a stationary support, the support structure insuring that the upper and lower wire grids are held apart. Also, the mattress is supported on a platform which is pivotably connected to the support by hinges, and is bordered by an upright board extending across a longitudinal or transverse dimension of the mattress. The board is pivotably connected by support links to the support. The board and/or the hinges are operative to prevent over-rotation of the platform, the spring assembly, and the collapsible springs therein.

Still another feature of this invention is embodied in the connection of the spring assembly to upper and lower border wires in the upper and lower wire grids. A plurality of upper grid wires extends in mutual parallelism along the longitudinal direction between the upper support element of the support structure and a transverse section of the upper border wire. Another plurality of lower grid wires extends in mutual parallelism along the longitudinal direction between the lower support element and a transverse section of the lower border wire. Each of these grid wires has a bow tie formation having two mirror-symmetrical loops. A plurality of ties each extends through one of these loops and around the border wire. The tie is configured as a ring and is easily fitted in place by automated machinery.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 9 is a top plan view of a collapsible spring used in the mattress of FIG. 8;

FIG. 10 is a side elevational view of the spring of FIG. 9 in an upright, uncompressed position;

FIG. 11 is an end elevational view of the uncompressed spring of FIG. 10;

FIG. 12 is a side elevational view of the spring used in the mattress of FIG. 8 during compression;

FIG. 14 is a view analogous to FIG. 12, but depicting a non-rigid, yieldable support structure for mounting the mattress to a support;

DETAILED DESCRIPTION OF THE PREFERRED EMBODIMENTS

The present invention is related to furniture, particularly motion furniture in which a body-supporting component thereof, for example, a mattress, a cushion, a pad or the like, is moved, typically from a storage position in which the body-supporting component is stored, to a use position in which the body-supporting component resiliently supports a human body. For ease of illustration and description, this invention is described for use in a foldaway or foldable bed in which the mattress is generally horizontal in its unfolded position to serve as a support for a sleeping occupant, and is generally vertical for compact storage in a Murphy-style fold-away bed, or folded over itself at least once, again for compact storage, in a sofa-bed convertible item of furniture. However, it will be expressly understood that this invention, especially as it relates to the structure, function and operation of a collapsible spring mechanism associated with the mattress can be used in other items of furniture which are not beds, such as fold-down seats. It should also be understood that the term furniture is not restricted to items found in one's house, but can equally well apply to items on recreational vehicles, trailers, boats and the like.

Figure 1:
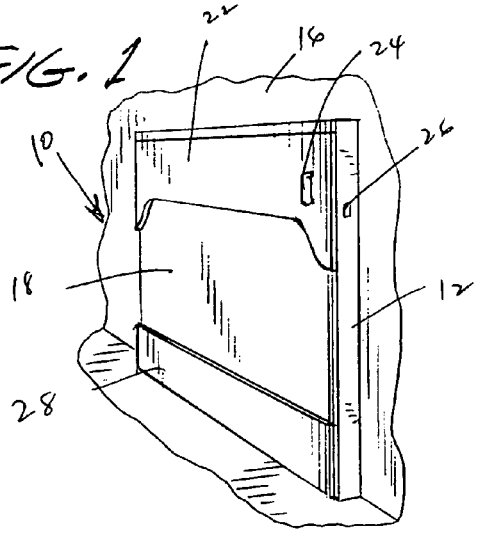
FIG. 1 is a perspective view of a foldaway wall bed having a mattress stored in a storage position in accordance with this invention.
Figure 4:
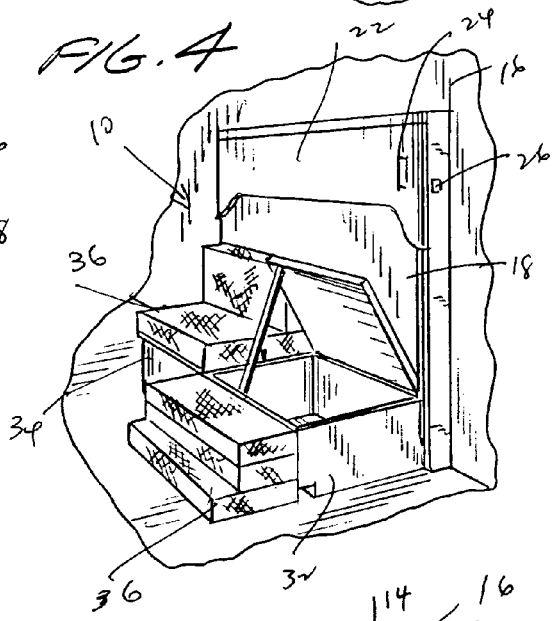
FIG. 4 is a perspective view of the couch of FIG. 3, but with one base cabinet open to stow the cushions therein.
Figure 5:
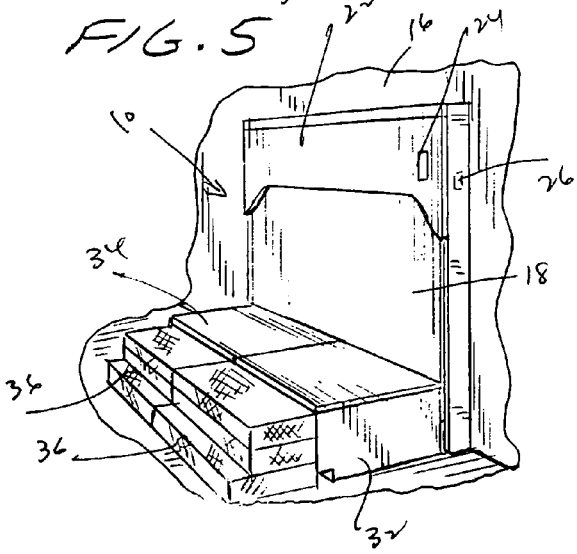
FIG. 5 is a perspective view of the couch of FIG. 3, but with the cushions positioned in front of the base cabinets preparatory to folding down the bed.
Figure 6:
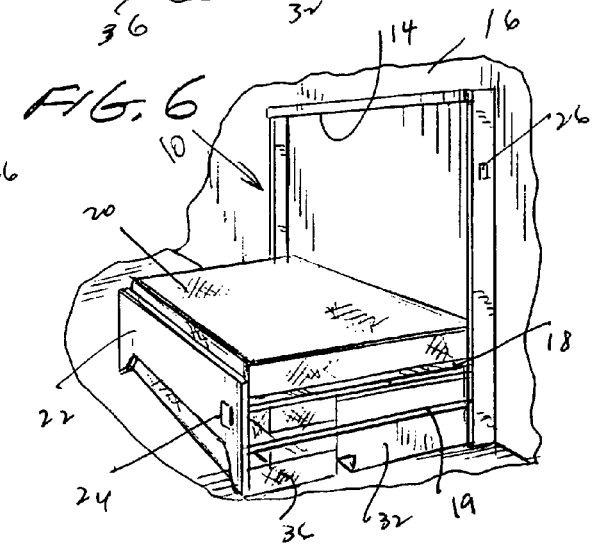
FIG. 6 is a perspective view of the bed of FIG. 5 folded down over the base cabinets and the cushions.

Thus, by way of non-limiting example, FIGS. 1-6 depict a foldaway Murphy-style bed 10 having a wall-mounted closet or cabinet 12 which frames an interior storage compartment 14 (FIG. 6) in which a mattress 20 is received in a storage position depicted in FIG. 1. As will be described herein, the mattress 20 is collapsed in the storage position and can fit into the cabinet 12 whose depth is on the order of 3-4 inches as measured with respective to a rear wall 16 on which the bed is mounted. However, as also described herein, the mattress 20 expands to a thickness on the order of nine inches when it has been unfolded to a body-supporting use position as depicted in FIG. 6. The increased thickness of the mattress in the use position provides increased sleeping comfort. The decreased thickness of the mattress in the storage position provides increased compact storage which is of particular benefit in applications, such as recreational vehicles, which have limited living space.

Reference numeral 18 depicts a planar platform on which the mattress is supported in the use position. A planar board 22 is co-planar with the platform 18 in the storage position, and is pivoted by support links 19 to be perpendicular to the platform to support the platform above the ground in the use position. A handle 24 on the board 22 enables the user to open and close the bed. A latch 26 on the cabinet holds the bed in the storage position until the latch is manually released. The board may extend across the side, foot or head of the mattress to serve as a sideboard, footboard, or headboard, respectively.

Figure 2:
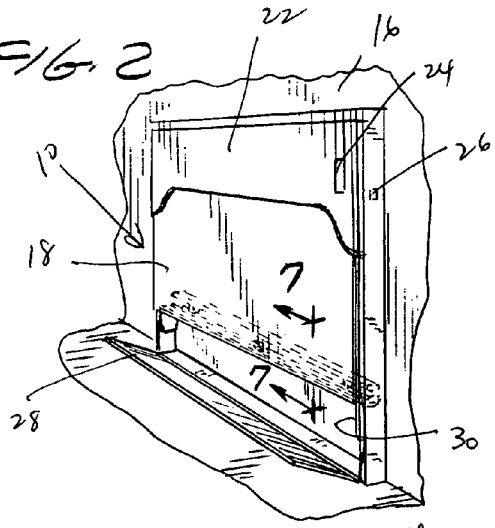
FIG. 2 is a perspective view of the bed of FIG. 1 depicting a hidden compartment for storage of extra items.
Figure 3:
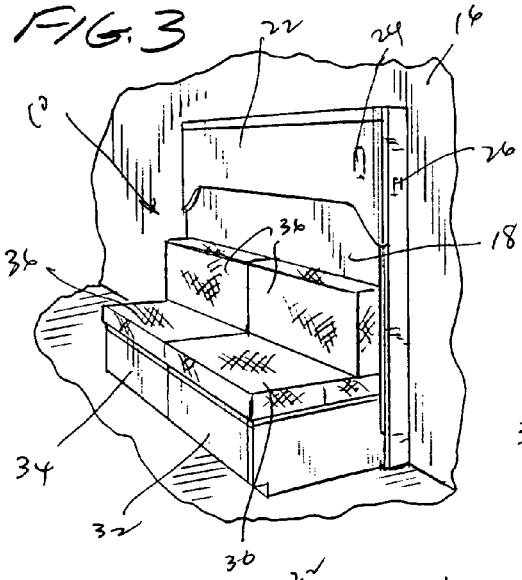
FIG. 3 is a perspective view of the bed of FIG. 1 in the storage position, but with base cabinets and cushions to form a couch.

As best shown in FIGS. 1-2, a lower panel 28 provided underneath the platform 18 is pivotable outwardly to expose a lower compartment 30 for storage of miscellaneous items. As best shown in FIGS. 3-4, a pair of base cabinets 32, 34 is situated in front of the folded bed, and a set of cushions 36 is placed on the cabinets to serve as a couch or seating area. Each cabinet is operable to receive the cushions therein, or to store additional items. The cushions may even be placed in front of the cabinets 32, 34 as shown in FIG. 5. When the bed is unfolded, as shown in FIG. 6, the cabinets and the cushions are accommodated underneath the platform 18.

The various furniture configurations of FIGS. 1-6 is of particular utility in cramped quarters. Comfort is not compromised. A great deal of storage area is available. The folded bed occupies a minimal amount of space and, of course, a couch and a bed are readily available for use.

Figure 7:
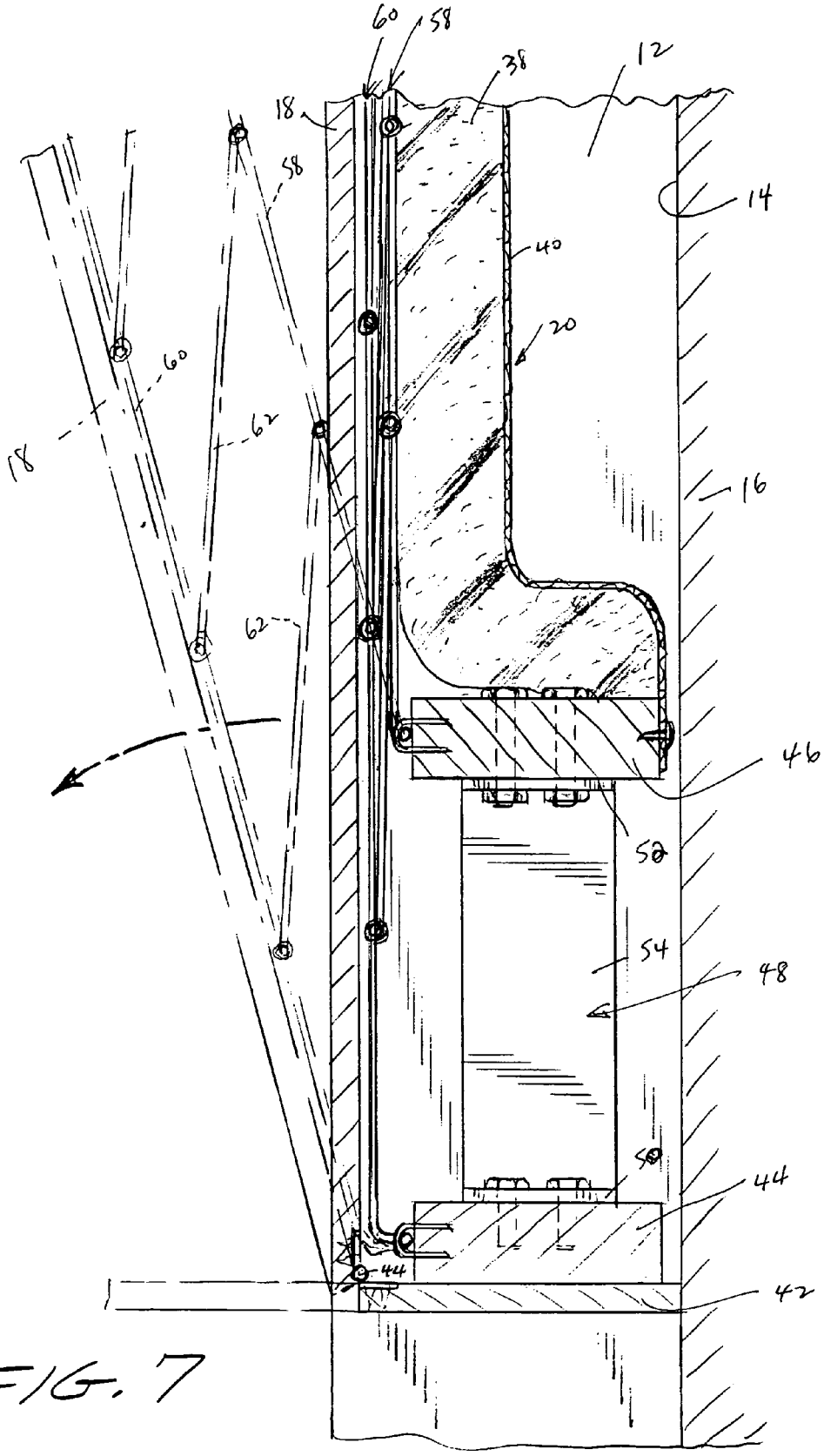
FIG. 7 is a broken-away, enlarged, vertical sectional view taken on line 7-7 of FIG. 1 depicting the mattress in the storage position in solid lines, and depicting the folding down of the bed in phantom lines.
Figure 8:
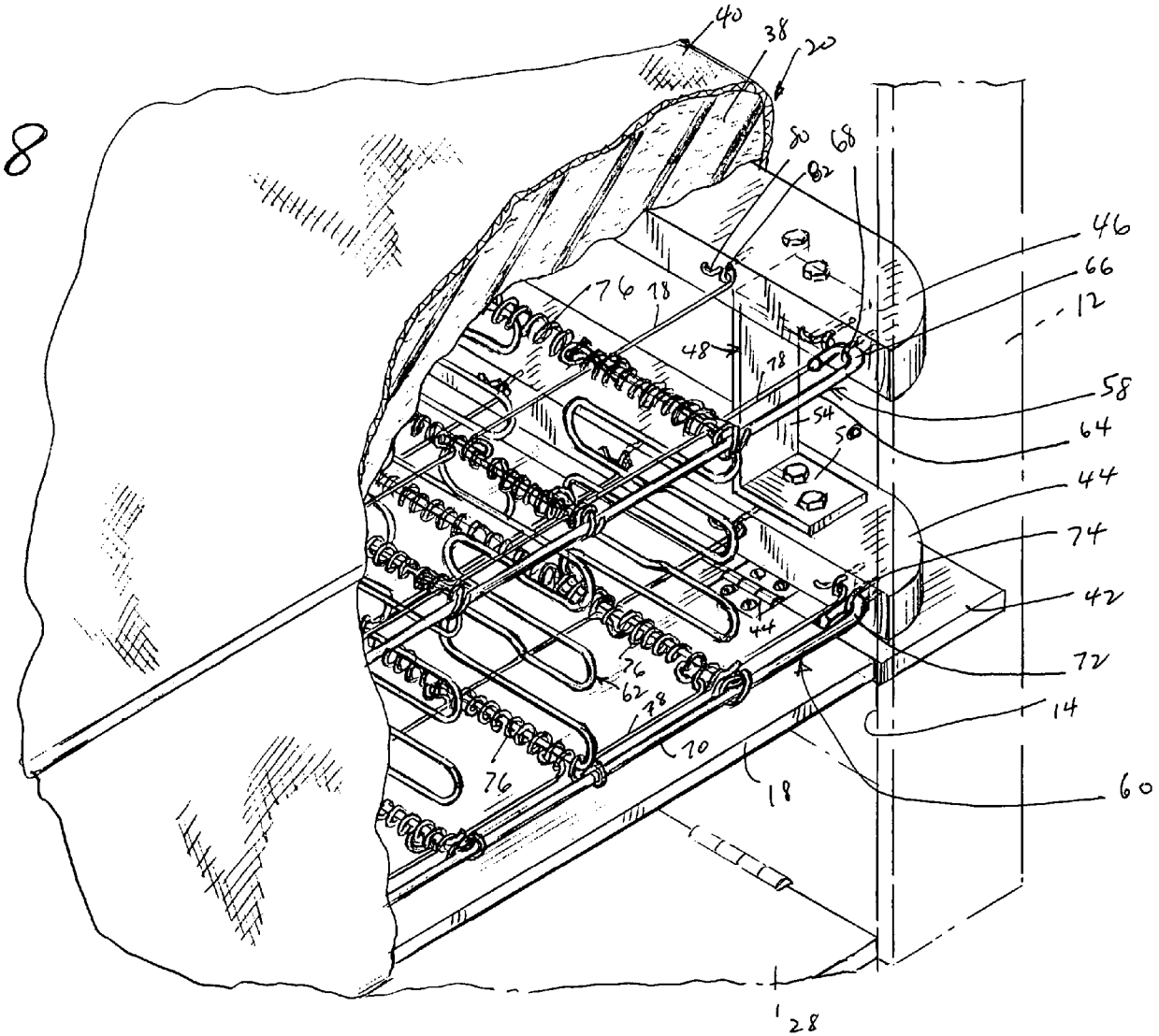
FIG. 8 is a broken-away, perspective view of a corner of one embodiment of the mattress after being folded down to a body-supporting use position.

Turning now to FIGS. 7-8, the mattress 20 includes a padding 38 of a soft, cushioned material encased in a sheath or mattress cover 40. The cabinet 12 includes a stationary planar support shelf 42 to which the platform 18 is pivotably connected by means of hinges 44. In the use position, the platform 18 is co-planar with the shelf 42.

A rigid, non-yielding support structure is mounted on the shelf 42 and includes a lower cross rail 44 fixedly connected by non-illustrated screws to the shelf 42, an upper cross rail 46 parallel to the lower rail 44, and a plurality of rigid elements 48 having lower 50 and upper 52 flanges screwed into the rails 44, 46, the flanges being spaced apart by a spacer 54 for holding the rails apart by a fixed spacing. The rigid support structure is advantageously covered by the padding 38 and the cover 40 as shown, but need not be. The rigid support structure is entirely accommodated in the storage compartment 14 and does not extend out over the platform 18 where it might otherwise present an unforgiving, uncomfortable location upon which to sleep.

A spring mechanism is mounted underneath the padding 38, and preferably within the mattress 20. The spring mechanism includes an upper wire grid 58, a lower wire grid 60, and a system of collapsible springs 62 pivotably connected to the grids for movement from a collapsed position (see FIG. 7) in which the grids are closely adjacent one another when the mattress is in the storage position, to an upright position (see FIG. 8) in which the grids are resiliently held and spaced apart by the collapsible springs when the mattress is in the use position. FIGS. 9-11 show a representative collapsible spring 62 unstressed in its upright position. FIG. 12 depicts the representative collapsible spring 62 stressed under a compressive load.

The upper grid 58 includes a rigid, thick, border wire 64 of U-shaped configuration in top plan view and having opposite ends 66 hooked through staples 68 for pivoting movement relative to the upper rail 46. Likewise, the lower grid 60 includes a rigid, thick, border wire 70 of U-shaped configuration and having opposite ends 72 hooked through staples 74 for pivoting movement relative to the lower rail 44.

A plurality of helical, interconnecting coils 76 extends in mutual parallelism transversely across the mattress in a transverse direction lengthwise of and parallel to the rails. As described below, a group of these interconnecting coils in the upper grid pivotably interconnect upper runs of the collapsible springs 62 that are co-linear along the transverse direction, and another group of these interconnecting coils in the lower grid pivotably interconnects lower runs of the collapsible springs 62 that are co-linear along the transverse direction.

A plurality of grid wires 78 extends in mutual parallelism longitudinally along the mattress in a longitudinal direction perpendicular to the transverse direction. An upper group of the grid wires 78 in the upper grid is connected to the group of interconnecting coils 76 therein, and a lower group of the grid wires 78 in the lower grid is connected to the group of interconnecting coils therein. The upper grid wires 78 have ends 80 hooked into staples 82 for pivoting movement relative to the upper rail 46, and likewise, the lower grid wires are pivotably connected int the same manner to the lower rail 44.

Figure 17:
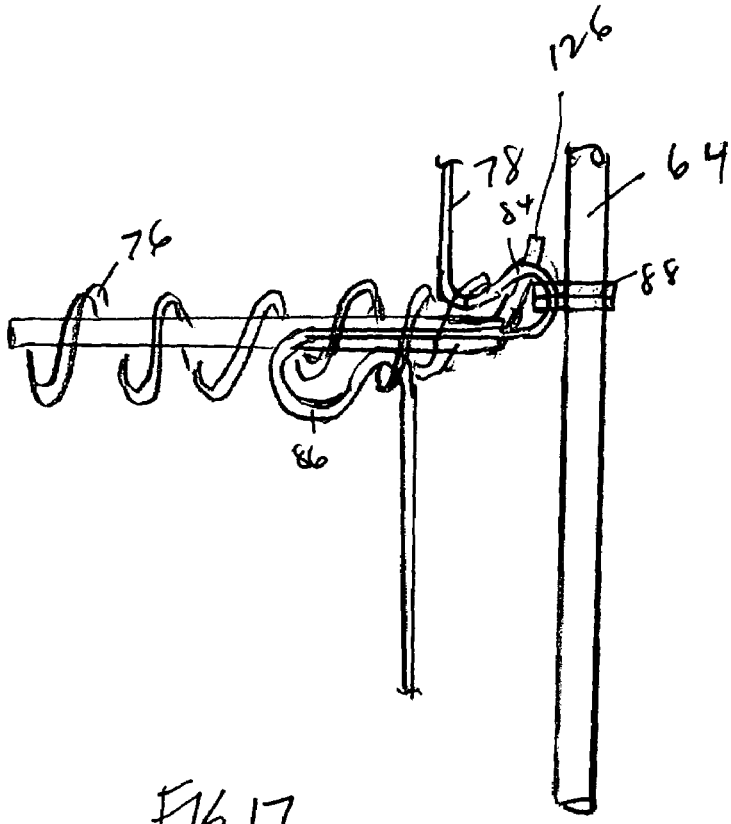
FIGS. 17-18 are enlarged plan views of a detail of the spring mechanism.
Figure 18:
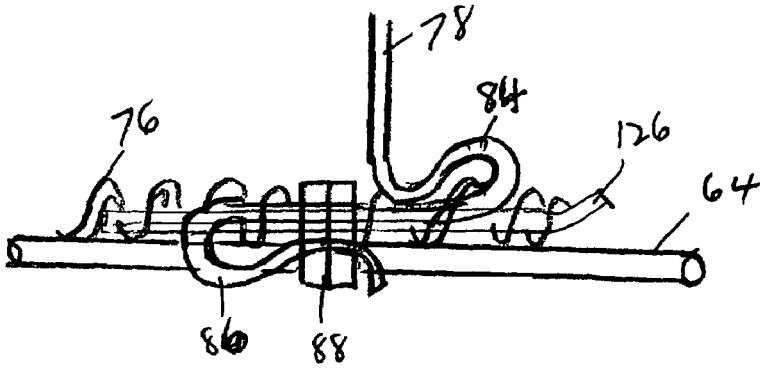

As best seen in FIGS. 17-18, each grid wire 78 is provided with a succession of spaced-apart bow tie formations, each having mirror symmetrical loops 84, 86. The loop that is closest to the border wire, for example upper border wire 64, is connected thereto by a hog ring 88. FIG. 17 depicts the closer loop 84 with respect to a longitudinal section of the border wire 64, whereas FIG. 18 depicts the closer loop 86 with respect to a transverse section of the border wire. Each interconnecting coil 76 not only pivotably interconnects the upper runs of the collapsible springs 62 as mentioned above, but also passes through and around the loops 84, 86 to secure the grid wires 78 to the coils 76 and the collapsible springs 62.

As best seen in FIGS. 9-11 for the representative collapsible spring 62, the spring 62 is a single length of sinuous wire formed into an upper linear run 100, a lower linear run 102, an upper intermediate linear run 104 connected to the upper run 100 by an arcuate portion 106, a lower intermediate linear run 108 connected to the lower run 102 by an arcuate portion 110, an upper offset run 112 connected to the intermediate run 104 by an arcuate portion 114, a lower offset run 116 connected to the intermediate run 108 by an arcuate portion 118, and a central linear run 120 connected to the offset runs 112, 116 by arcuate portions 122, 124.

In contrast to the sinuous spring disclosed in U.S. Pat. No. 5,540,418, the spring 62 of the current invention has the following features. First, each end of the upper and lower runs 100, 102 is bent to form hooks 126, 128. These hooked ends 126, 128 extend through spaces between adjacent windings of the upper and lower interconnecting coils 76 and affirmatively prevent the upper and lower runs 100, 102 from binding and/or snapping off the coils 76 with concomitant snapping or popping sounds when the user rolls over the mattress as schematically illustrated in FIG. 12. In the prior art, as exemplified by U.S. Pat. No. 5,540,418, the upper and lower runs of the sinuous spring have straight ends. As the springs 62 are compressed, the springs tend to pull on the interconnecting coils which stretches to accommodate such tension. Eventually, the upper and lower runs snap off their coils 76, creating noise which, if the mattress is used with a lower platform 18, is magnified since the platform acts as a sound board or drum. The hooked ends 126, 128 effectively prevent such mechanical binding and noise.

Secondly, each of the sinuous springs 62 of this invention has center offsets 130, 132 in the offset runs 112, 116. This permits a greater deflection of the springs 62 when under compression. As shown in FIG. 12, the arcuate portions 106, 122, 118, 114, 124, 110 bypass one another during compression. In the prior art as exemplified by U.S. Pat. No. 5,655,240, only the ends of the runs are offset, thereby limiting the extent to which the springs may be compressed.

Thirdly, each of the sinuous springs of U.S. Pat. No. 5,655,240 has offset stops in the upper and lower runs thereof. These offset stops abut against opposing tongue portions in the grid wires to prevent over-rotation in the upright position. Without such stops, the springs have a tendency to rotate beyond their upright position during opening of the bed, or under a compressive load. Such rotation causes the mattress to shift or collapse.

In accordance with this invention, offset stops are not provided in the collapsible springs, nor are abutting tongue portions provided in the grid wires. This generally simplifies the manufacture of the collapsible springs and the grid wires and allows them to be readily made and assembled by automated machinery.

Prevention of over-rotation of the collapsible springs past the upright position is aided in accordance with this invention by, in the case of the embodiment of FIG. 8, the rigid support structure wherein the stationary rigid elements 48 insure that the lower and upper rails 44, 46 as well as the upper and lower grids 58, 60 are held a fixed distance apart. Also, the hinges 44 and the upright floor-engaging board 22 insure that the platform 18 will not rotate past the plane of the shelf 42. Thus, the over-rotation function has been transferred away from the spring mechanism.

Still another advantage of the spring mechanism according to this invention over the prior art is that the interconnecting coils 76 run along the entire length of each upper 100 and lower 102 run of the collapsible springs. In the prior art, the offset portions used for over-rotation prevention were not surrounded by the interconnecting coils 76, thereby weakening the spring mechanism.

Figure 13:
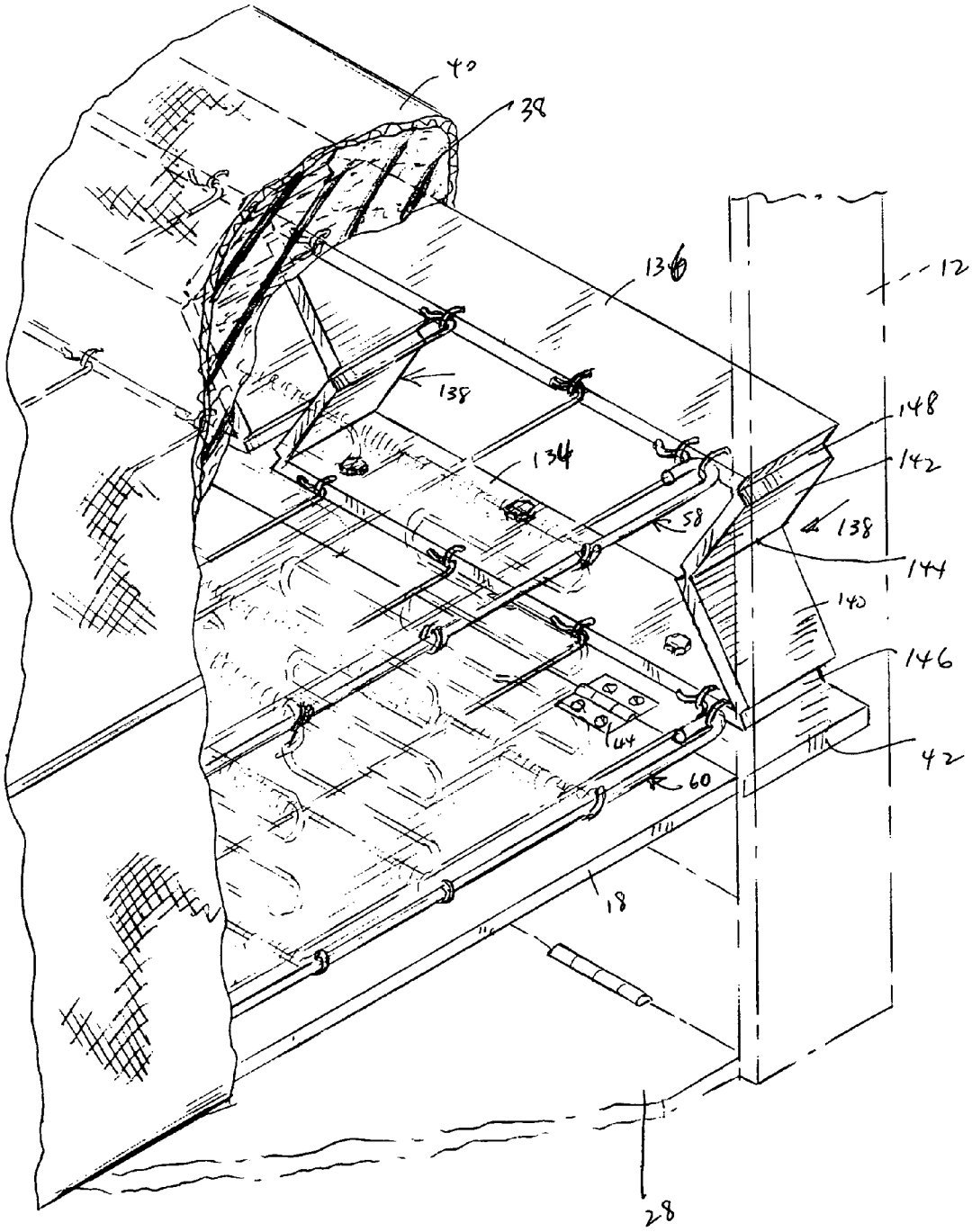
FIG. 13 is a view analogous to FIG. 8, but of another embodiment of the mattress.
Figure 15:
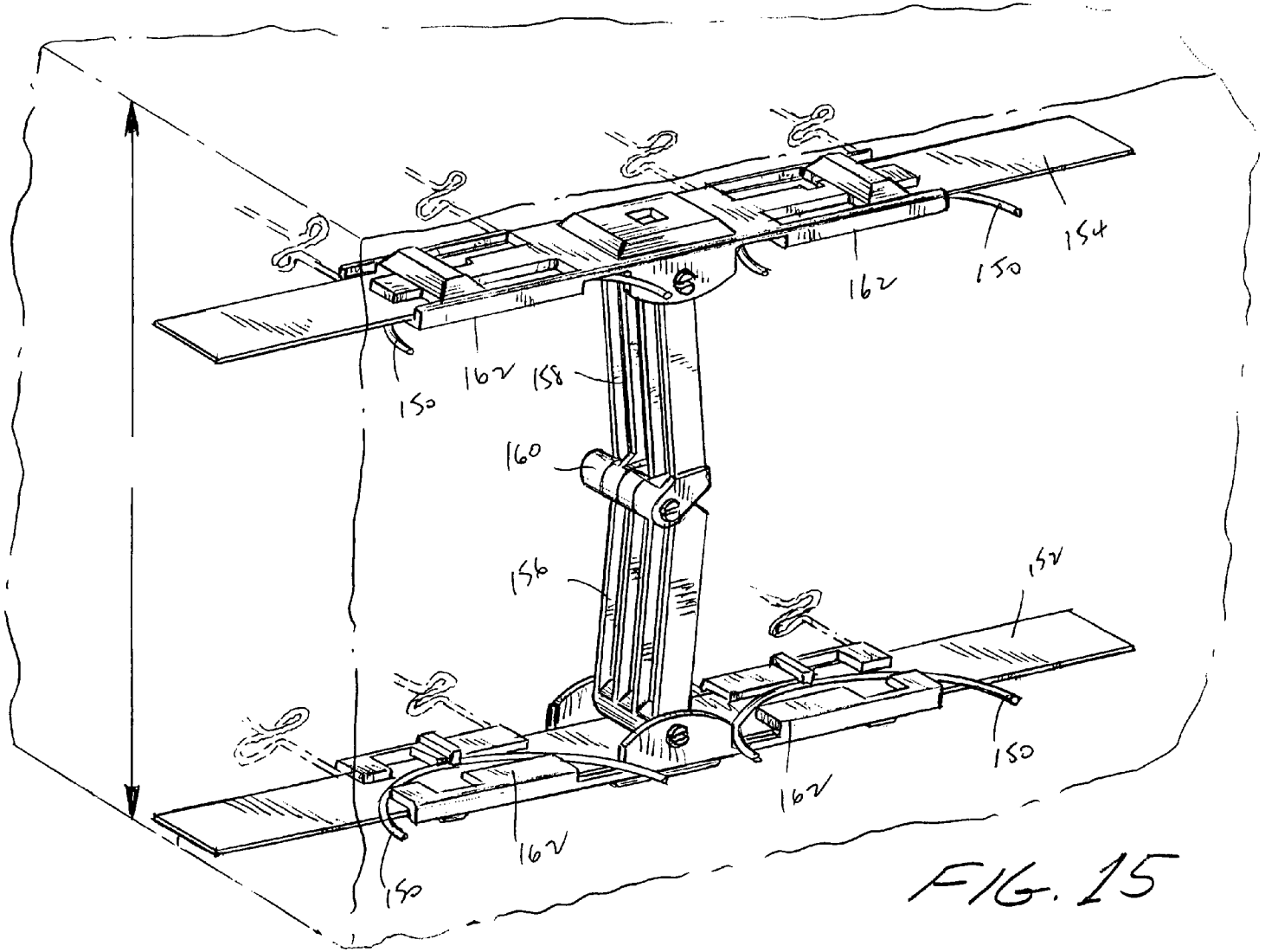
FIG. 15 is a perspective view of another non-rigid, yieldable support structure for mounting the mattress to a support.
Figure 16:
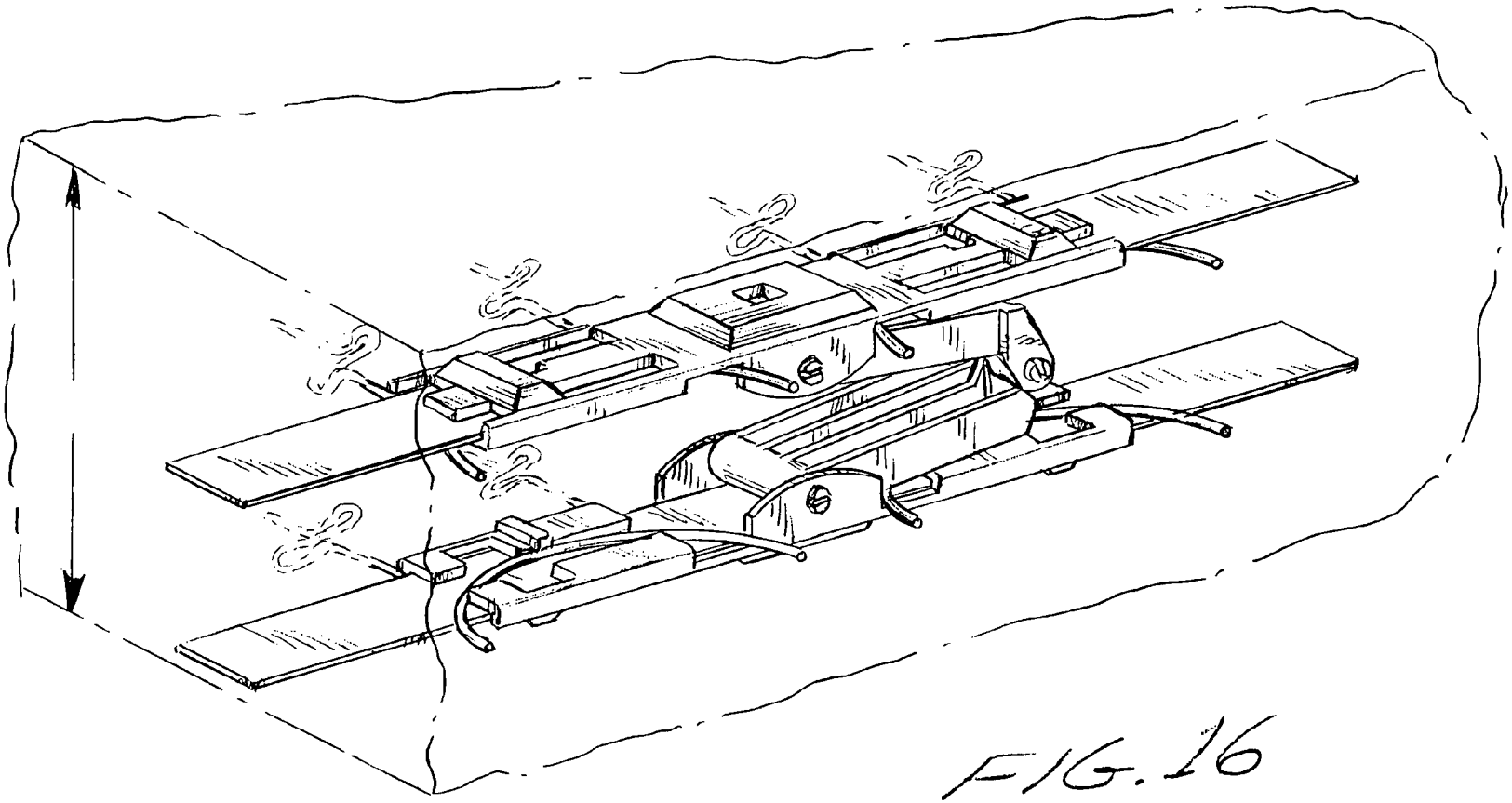
FIG. 16 is a view analogous to FIG. 15, but depicting the non-rigid, yieldable support structure in a collapsed position.

Rather than employing a rigid support structure, this invention also proposes using yieldable support structures such as depicted in the embodiment of FIGS. 13-14 or the embodiment of FIGS. 15-16. The yieldable structure of FIGS. 13-14 includes a pair of lower and upper beams 134, 136 analogous to rails 44, 46, but held apart by yieldable elements 138. Preferably, the beams 134, 136 are constituted of plastic, and each element 138 includes a pair of lower and upper living hinge portions 140, 142 connected to each other by living hinge 144 and to the lower and upper beams by living hinges 146, 148.

When subjected to a compressive load during use as a bed, the hinge portions 140, 142 collapse, as shown in FIG. 14. When the load is relieved, the hinge portions 140, 142 self return to their uncollapsed upright positions.

The yielding characteristic of this support structure is advantageous in that it will be more comfortable for the user being supported by a yieldable structure than by a rigid structure. This is perhaps not that important when the yieldable or rigid structure is fully contained within the cabinet 12, that is, at a location where the user cannot access readily. However, the yieldable structure need not be located within a cabinet, but could be located, for example, in the middle of the mattress which is to be folded over once, or can be located at spaced-apart locations of the mattress which is to be folded over twice. Despite the presence of padding 38, a rigid support structure in the sleeping area of the mattress would be uncomfortable, but a yieldable structure would be acceptable.

The use of a yieldable structure within the sleeping area of a mattres is recommended for convertible sofa-beds, or as a transition between different types of spring mechanisms. For example, the head and middle sections of a mattress may be supported by conventional Bonnell-type coil springs, but the foot section of the mattress may be supported by the collapsible spring mechanism of this invention. In that case, the yieldable support structure is positioned between the transition between the coil springs and the collapsible spring mechanism.

Despite the yieldable nature of the support structure, the over-rotation function is still primarily performed by the hinges 44 and the upright board 22 which prevent the platform 18 from moving past the plane of the shelf 42. Also, without a compressive load, the lower and upper beams 134, 136 are held apart due to the stiffness of the living hinges.

The yieldable support structure of FIGS. 15-16 is likewise mountable on the support shelf 42 within the cabinet, or preferably, in the sleeping area of the mattress in the transition between conventional Bonnell-type coil springs, as represented by coils 150, and the collapsible spring mechanism of this invention. The yieldable structure of FIGS. 15-16 includes lower and upper bars 152, 154 pivotably connected to lower and upper links 156, 158 which, in turn, are pivotably connected at pivot 160. Spring retainers 162 on the bars 152, 154 capture lower and upper convolutions of the Bonnell-type coil springs 150.

When subjected to a compressive load during use as a bed, the links 156, 158 pivot, as shown in FIG. 16, thereby increasing a user's comfort. When the load is relieved, the links 156, 158 self return to their upright position by return springs located within the pivot 160.

It will be understood that each of the elements described above, or two or more together, also may find a useful application in other types of constructions differing from the types described above.

While the invention has been illustrated and described as embodied in collapsible spring mechanisms for items of furniture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

I claim:

1. A furniture item, comprising:

a support having a stationary, generally planar shelf extending along a transverse direction, and a generally planar platform hinged to the shelf for movement about a hinge axis extending along the transverse direction;

a movable mattress mounted on the support for movement between a storage position and a body-supporting use position, the mattress including a spring assembly having an upper wire grid, a lower wire grid, and a system of springs pivotably connected to the grids for movement from a compact position in which the grids are adjacent one another when the mattress is in the storage position, along an opening direction, to an upright position in which the grids are resiliently held and spaced apart by the springs when the mattress is in the use position; and a support structure remote from the springs and operatively connected between the spring assembly and the support, for resisting movement of the springs along the opening direction past the upright position, and for maintaining the springs in the upright position when the mattress is in the use position, the support structure including a lower support element fixed to, and extending along, the shelf along the transverse direction and pivotably connected to the lower wire grid, and an upper support element located above, and extending in mutual parallelism with, the lower support element along the transverse direction and pivotably connected to the upper wire grid.

2. The furniture item of claim 1, wherein the support is a wall-mounted cabinet having a storage cavity for receiving the mattress in the storage position.

3. The furniture item of claim 1, wherein the platform is coplanar with the shelf and supports the mattress in the use position.

4. The furniture item of claim 1, wherein the upper and lower support elements of the support structure are rigidly held apart.

5. The furniture item of claim 1, wherein the upper and lower support elements of the support structure are yieldably held apart.

6. The furniture item of claim 1, wherein each upper and lower wire grid has upper and lower border wires, each border wire having a transverse section generally parallel to and spaced from the upper and lower support elements, and a pair of longitudinal sections generally perpendicular, and pivotably connected, to a respective support element.

7. The furniture item of claim 6, wherein the system of springs is arranged along transverse rows and longitudinal columns, each spring having linear uppermost and lowermost runs; and wherein the assembly includes a plurality of interconnecting upper coils extending in mutual parallelism along the transverse direction for entirely surrounding and interconnecting the linear uppermost runs in the transverse rows, and a plurality of interconnecting lower coils extending in mutual parallelism along the transverse direction for entirely surrounding and interconnecting the linear lowermost runs in the transverse rows.

8. The furniture item of claim 7, wherein at least one end of at least one of the linear uppermost and lowermost runs of at least one of the springs is bent to form a hook that extends through, and hookingly engages, at least one of the interconnecting coils.

9. The furniture item of claim 7, wherein the assembly includes a plurality of upper grid wires extending in mutual parallelism along a longitudinal direction perpendicular to the transverse direction between the upper support element and the transverse section of the upper border wire, and a plurality of lower grid wires extending in mutual parallelism along the longitudinal direction between the lower support element and the transverse section of the lower border wire, each grid wire having a pair of loops through which the interconnecting coils are wound.

10. The furniture item of claim 9, and a plurality of ties each extending through one of the loops of a respective grid wire and around a respective border wire.

11. The furniture item of claim 7, wherein each spring has additional runs between its respective uppermost and lowermost linear runs, and wherein at least one of the additional runs has a central offset to enable adjacent runs to bypass each other when the spring is subjected to compression.

* * * * *